US010279221B2

(12) United States Patent
Watanabe

(10) Patent No.: US 10,279,221 B2
(45) **Date of Patent: *May 7, 2019**

(54) GOLF BALL

(71) Applicant: Bridgestone Sports Co., Ltd., Tokyo (JP)

(72) Inventor: Hideo Watanabe, Chichibushi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/956,912

(22) Filed: Apr. 19, 2018

(65) Prior Publication Data

US 2018/0236311 A1 Aug. 23, 2018

Related U.S. Application Data

(63) Continuation-in-part of application No. 15/047,743, filed on Feb. 19, 2016, now Pat. No. 9,975,008.

(30) Foreign Application Priority Data

Mar. 2, 2015 (JP) ..... 2015-040086

(51) Int. Cl.

| | |
|---|---|
| ***A63B 37/06*** | (2006.01) |
| ***A63B 37/00*** | (2006.01) |
| *A63B 45/00* | (2006.01) |

(52) U.S. Cl.

CPC ..... *A63B 37/0081* (2013.01); *A63B 37/0033* (2013.01); *A63B 37/0063* (2013.01); *A63B 37/0064* (2013.01); *A63B 37/0065* (2013.01); *A63B 37/0074* (2013.01); *A63B 37/0075* (2013.01); *A63B 37/0076* (2013.01); *A63B 45/00* (2013.01)

(58) Field of Classification Search

CPC ..... A63B 37/0081; A63B 37/0065
USPC ..... 473/371
See application file for complete search history.

(56) References Cited

U.S. PATENT DOCUMENTS 5,403,010 A 4/1995 Yabuki et al.
5,695,413 A 12/1997 Yamagishi et al.
(Continued)

FOREIGN PATENT DOCUMENTS

JP 08-294549 A 11/1996
JP 2004-322347 A 11/2004
(Continued)

OTHER PUBLICATIONS

Communication dated Jan. 8, 2019 from Japanese Patent Office in counterpart JP Application No. 2015-040086.

*Primary Examiner* — Raeann Gorden
(74) *Attorney, Agent, or Firm* — Sughrue Mion, PLLC

(57) ABSTRACT

In a golf ball having a core and a cover of one or more layers, letting the core diameter be D (mm), the cover thickness be T (mm) and the core and ball deflections when compressed under a final load of 1,275 N (130 kgf) from an initial load state of 98 N (10 kgf) be E (mm) and B (mm), the following conditions are satisfied: (1) 30≥D/T≥24, (2) 4.1≥E/T≥2.6, and (3) 1.18≥EIB≥1.09, and the core has specific hardness profile. This golf ball provides an excellent flight performance and a soft feel at impact when used by golfers whose head speed is not very fast, such as senior golfers and women golfers. The ball also has a high durability to cracking on repeated impact.

9 Claims, 1 Drawing Sheet

(56) References Cited

U.S. PATENT DOCUMENTS

| | | | | |
|---|---|---|---|---|
| 5,743,817 | A | 4/1998 | Yamagishi et al. | |
| 5,803,833 | A | 9/1998 | Nakamura et al. | |
| 5,813,924 | A | 9/1998 | Yamagishi et al. | |
| 9,975,008 | B2 * | 5/2018 | Watanabe ..... | A63B 37/0033 |
| 2008/0132358 | A1 | 6/2008 | Komatsu | |
| 2012/0277020 | A1 | 11/2012 | Higuchi et al. | |
| 2012/0277021 | A1 | 11/2012 | Higuchi et al. | |
| 2012/0302371 | A1 | 11/2012 | Nanba et al. | |
| 2012/0302373 | A1 | 11/2012 | Nanba et al. | |
| 2013/0172108 | A1 | 7/2013 | Higuchi et al. | |
| 2013/0303307 | A1 | 11/2013 | Sakamine et al. | |

FOREIGN PATENT DOCUMENTS

| | | | |
|---|---|---|---|
| JP | 2012-245353 | A | 12/2012 |
| JP | 2013-138840 | A | 7/2013 |
| JP | 2013-236672 | A | 11/2013 |

* cited by examiner

GOLF BALL

CROSS-REFERENCE TO RELATED APPLICATION

This application is a continuation-in-part of copending application Ser. No. 15/047,743 filed on Feb. 19, 2016, the entire contents of which are hereby incorporated by reference.

TECHNICAL FIELD

The present invention relates to a golf ball having a core and a cover of one or more layer. More particularly, the invention relates to a golf ball having a good flight performance and a soft feel when used by golfers whose head speeds are not very fast, such as senior golfers and women golfers.

BACKGROUND ART

Various golf balls have been developed recently so as to provide an excellent flight performance and a soft feel, not only when used by professional golfers and skilled amateurs, but even when used by golfers whose head speeds are not very fast, such as senior golfers and women golfers.

Such golf balls are described in, for example, U.S. Pat. No. 5,695,413 (and the corresponding JP-A 8-294549), U.S. Published Patent Application No. 2012/0302373, U.S. Pat. No. 5,743,817 and U.S. Pat. No. 5,813,924.

However, these golf balls have a low durability to cracking, or they provide a satisfactory flight performance but lack a soft feel. Hence, there remains room for improvement in the development of golf balls capable of fully satisfying the needs of senior golfers and women golfers.

It is therefore an object of this invention to provide a golf ball which can achieve a good flight performance and a soft feel when played by amateur golfers whose head speeds are not very fast, such as senior golfers and women golfers, and which, moreover, has a satisfactory durability.

SUMMARY OF THE INVENTION

As a result of extensive investigations, we have discovered that by setting the deflection of the golf ball core under a specific load to a large value and making the overall core soft, and moreover by having the values D/T, E/T and E/B satisfy certain specific ranges, where D (mm) is the core diameter, T (mm) is the cover thickness and E (mm) and B (mm) are respectively the core deflection and the golf ball deflection when these spheres are compressed under a final load of 1,275 N (130 kgf) from an initial load state of 98 N (10 kgf), there can be obtained a golf ball which, when used by amateur golfers whose head speed is not very fast, such as senior golfers and women golfers, not only imparts a soft feel at impact, but also is capable of achieving a high initial velocity, enabling an excellent flight performance to be obtained, and moreover can retain a sufficient durability to cracking.

Accordingly, in a first aspect, the invention provides a golf ball having a core and a cover of one or more layer, wherein, letting the core have a diameter D (mm), the cover have a thickness T (mm), and the core and the golf ball have respective deflections E (mm) and B (mm) when compressed under a final load of 1,275 N (130 kgf) from an initial load state of 98 N (10 kgf), the following conditions (1) to (3) below are satisfied: (1) $30 \geq D/T \geq 24$, (2) $4.1 \geq E/T \geq 2.6$, and (3) $1.18 \geq E/B \geq 1.09$ and wherein the initial velocity of the ball is from 76.5 to 77.724 m/s, and wherein the core has a hardness profile with, expressed in terms of JIS-C hardness, a core center hardness of 58±5, a hardness at a position 5 mm from the core center of 62±5, a hardness at a position 10 mm from the core center of 65±5, a hardness at a position 15 mm from the core center of 70±5, and a hardness on a surface of the core of 75±5.

In formula (3), B is preferably at least 3.8 mm, and E is preferably from 4.4 to 6.0 mm.

In the core hardness profile, the JIS-C hardness value obtained by subtracting the core center hardness from the core surface hardness is preferably at least 10 and up to 25.

In formula (2), E/T is preferably at least 3.2 and up to 3.5.

Also, the material hardness of each cover layer, expressed in terms of Shore D hardness, is preferably from 50 to 60. The Shore D hardness value obtained by subtracting the core surface hardness from the ball surface hardness (ball surface hardness-core surface hardness), is preferably from 5 to 25.

Further, in the core material, it is preferable that the core is formed primarily of a rubber material including a base rubber and zinc acrylate as a co-crosslinking agent. In this case, the amount of zinc acrylate is preferably from 10 to 27.5 parts by weight, per 100 parts by weight of the base rubber.

Advantageous Effects of the Invention

The golf ball of the invention, when used by amateur golfers whose head speed is not very fast, provides a soft feel at impact and also achieves a high initial velocity, enabling an excellent flight performance to be obtained. Moreover, the ball is able to retain a sufficient durability to cracking.

BRIEF DESCRIPTION OF THE DIAGRAMS

DESCRIPTION OF THE PREFERRED EMBODIMENTS

Figure 1:
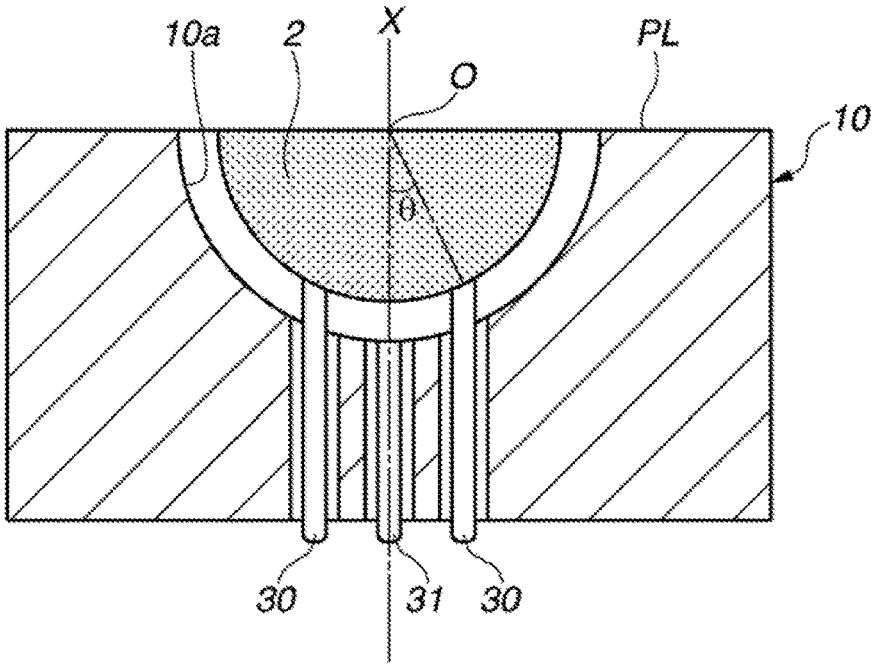
FIG. 1 is a schematic sectional diagram showing the position of support pins arranged in a mold for use in manufacturing the golf ball of the invention.

The objects, features and advantages of the invention will become more apparent from the following detailed description, taken in conjunction with the foregoing diagrams.

The golf ball of the invention includes a core and a cover. The core may consist of a single layer or may have a two-layer construction consisting of an inner layer and an outer layer. The cover may consist of a single layer or of two or more layers. Although not shown in the diagrams, examples include two-piece solid golf balls having a single-layer core and a single-layer cover, and three-piece solid golf balls having a single-layer core encased by a two-layer cover consisting of an inner layer and an outer layer. Numerous dimples are generally formed on an outer is surface of the cover.

The core diameter, although not particularly limited, is preferably at least 39.1 mm, more preferably at least 39.4 mm, and even more preferably at least 39.7 mm, with the upper limit being preferably not more than 40.5 mm, more preferably not more than 40.1 mm, and even more preferably not more than 39.9 mm. When the core has an inner layer and an outer layer, the core diameter refers to the diameter of the overall core.

The core has a deflection (mm) when compressed under a final load of 1,275 N (130 kgf) from an initial load of 98 N (10 kgf) which, although not particularly limited, is preferably at least 3.5 mm, more preferably at least 4.0 mm, and even more preferably at least 4.3 mm, with the upper limit being preferably not more than 6.0 mm, more preferably not more than 5.2 mm, and even more preferably not more than 4.8 mm. When this value is too large (i.e., when the core is too soft), the feel of the ball at impact may lack crispness and the durability to cracking on repeated impact may worsen. Conversely, when this value is too small, the feel at impact may be too hard, the spin rate on full shots may increase, and the ball may not achieve the intended distance.

The core has a hardness profile which, although not particularly limited, is preferably such as to have a core center hardness, a hardness at a position 5 mm from the core center, a hardness at a position 10 mm from the core center, a hardness at a position 15 mm from the core center and a hardness at the surface of the core which are adjusted within the respective ranges indicated below.

The center hardness of the core, expressed in terms of JIS-C hardness, is preferably in the range of 58±5, more preferably in the range of 58±3, and even more preferably in the range of 58±2.

The hardness at a position 5 mm from the core center, expressed in terms of JIS-C hardness, is preferably in the range of 62±5, more preferably in the range of 62±3,and even more preferably in the range of 62±2.

The hardness at a position 10 mm from the core center, expressed in terms of JIS-C hardness, is preferably in the range of 65×5, more preferably in the range of 65±3, and even more preferably in the range of 65±2.

The hardness at a position 15 mm from the core center, expressed in terms of JIS-C hardness, is preferably in the range of 70±5, more preferably in the range of 70±3, and even more preferably in the range of 70±2.

The hardness at the surface of the core, expressed in terms of JIS-C hardness, is preferably in the range of 75±5, more preferably in the range of 75±3, and even more preferably in the range of 75±2.

When the hardnesses at the respective places in the above core hardness profile—i.e., the core center hardness, the hardness at a position 5 mm from the core center, the hardness at a position 10 mm from the core center, the hardness at a position 15 mm from the core center, and the core surface hardness—are larger than the above-indicated values, the feel at impact may be too hard or the spin rate on full shots may rise excessively, as a result of which a good distance may not be achieved. On the other hand, when the hardnesses in the core hardness profile are smaller than the above values, the durability to cracking on repeated impact may worsen and the rebound may decrease, as a result of which a good distance may not be achieved.

In the above core hardness profile, the JIS-C hardness value obtained by subtracting the core center hardness from the core surface hardness (core surface hardness—core center hardness) is preferably at least 10, more preferably at least 12, and even more preferably at least 14, with the upper limit being preferably not more than 25, more preferably not more than 23, and even more preferably not more than 21. When this value is too large, the durability to cracking on repeated impact may worsen, and the initial velocity of the ball when struck may decrease, as a result of which the intended distance may not be achieved. On the other hand, when this value is too small, the spin rate on shots with a W#1 club may increase, as a result of which the intended distance may not be achieved.

The core has an initial velocity which, although not particularly limited, is preferably adjusted so as to be higher than the initial velocity of the ball. Specifically, the initial velocity of the core is preferably at least 77.3 m/s, and more preferably at least 77.6 m/s. When the initial velocity of the core is too low, the initial velocity of the ball tends to decrease; on shots with a W# club, the initial velocity of the ball may decrease, as a result of which the intended distance may not be achieved. The value obtained by subtracting the ball initial velocity from the core initial velocity is preferably larger than 0 m/s, more preferably at least 0.2 m/s, and even more preferably at least 0.5 m/s. The initial velocities of the core and the ball are measured using the measurement apparatus and conditions described subsequently under Initial Velocities of Core and Ball in the "Examples" section of this specification.

It is preferable for the core having the above-indicated hardness profile and deflection to be made primarily of a rubber material. Specifically, use can be made of a rubber composition prepared by compounding a base rubber as the chief material, a co-crosslinking agent, an organic peroxide, an inert filler and, optionally, an organosulfur compound. The rubber composition is described more fully below. The use of a polybutadiene as the base rubber is preferred.

The polybutadiene is preferably one having a cis-1,4 bond content on the polymer chain of at least 60 wt %, preferably at least 80 wt %, more preferably at least 90 wt %, and most preferably at least 95 wt %. At too low a content of cis-1,4 bonds among the bonds on the polybutadiene molecule, the resilience may decrease.

Rubber ingredients other than the above polybutadiene may be included in the rubber base, provided that doing so does not detract from the advantageous effects of the invention. Illustrative examples of rubber ingredients other than the above polybutadiene include other polybutadienes and also other diene rubbers, such as styrene-butadiene rubber, natural rubber, isoprene rubber and ethylene—propylene—diene rubber.

Examples of co-crosslinking agents include unsaturated carboxylic acids and the metal salts of unsaturated carboxylic acids.

Specific examples of unsaturated carboxylic acids include acrylic acid, methacrylic acid, maleic acid and fumaric acid. The use of acrylic acid or methacrylic acid is especially preferred.

Metal salts of unsaturated carboxylic acids include, without particular limitation, the above unsaturated carboxylic acids that have been neutralized with desired metal ions. Specific examples include the zinc salts and magnesium salts of methacrylic acid and acrylic acid. The use of zinc acrylate is especially preferred.

The unsaturated carboxylic acid and/or metal salt thereof is included in an amount, per 100 parts by weight of the base rubber, which is preferably at least 10 parts by weight, more preferably at least 15 parts by weight, and even more preferably at least 20 parts by weight. The amount included is preferably not more than 60 parts by weight, more preferably not more than 50 parts by weight, even more preferably not more than 45 parts by weight, and most preferably not more than 40 parts by weight. Too much may make the core too hard, giving the ball an unpleasant feel at impact, whereas too little may lower the rebound.

The organic peroxide may be a commercially available product, specific examples of which include Percumyl D, Perhexa C-40 and Perhexa 3M, (all from NOF Corporation), and Luperco 231XL (Atochem Co.). These may be used singly or two or more may be used together.

The amount of organic peroxide included per 100 parts by weight of the base rubber is preferably at least 0.1 part by weight, more preferably at least 0.3 part by weight, even more preferably at least 0.5 part by weight, and most preferably at least 0.7 part by weight. The upper limit is is preferably not more than 5 parts by weight, more preferably not more than 4 parts by weight, even more preferably not more than 3 parts by weight, and most preferably not more than 2 parts by weight. When too much or too little is included, it may not be possible to obtain a ball having a good feel, durability and rebound.

Examples of preferred inert fillers include zinc oxide, barium sulfate, calcium carbonate and titanium oxide. These may be used singly or two or more may be used in combination.

The amount of inert filler included per 100 parts by weight of the base rubber is preferably at least 1 part by weight, more preferably at least 2 parts by weight, and even more preferably at least 4 parts by weight. The upper limit is preferably not more than 50 parts by weight, more preferably not more than 40 parts by weight, and even more preferably not more than 35 parts by weight. Too much or too little inert filler may make it impossible to obtain a proper weight and a good rebound.

In addition, an antioxidant may be optionally included. Illustrative examples of suitable commercial antioxidants include Nocrac NS-6 and Nocrac NS-30 (Ouchi Shinko Chemical Industry Co., Ltd.), and Yoshinox 425 (Yoshitomi Pharmaceutical Industries, Ltd.). These may be used singly or two or more may be used in combination.

The amount of antioxidant included per 100 parts by weight of the base rubber is 0 part by weight or more, preferably at least 0.05 part by weight, and more preferably at least 0.1 part by weight. The upper limit is preferably not more than 3 parts by weight, more preferably not more than 2 parts by weight, even more preferably not more than 1 part by weight, and most preferably not more than 0.5 part by weight. Too much or too little antioxidant may make it impossible to achieve a good rebound and durability.

The organosulfur compound is not particularly limited, provided it is capable of increasing the golf ball rebound. Exemplary organosulfur compound are thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and diphenylpolysulfides, dibenzylpolysulfides, dibenzoylpolysulfides, dibenzothiazoylpolysulfides and dithiobenzoylpolysulfides having from 2 to 4 sulfurs. The use of the zinc salt of pentachlorothiophenol is especially preferred.

It is recommended that the organosulfur compound be included in an amount, per 100 parts by weight of the base rubber, of preferably at least 0.05 part by weight, more preferably at least 0.1 part by weight, and even more preferably at least 0.2 part by weight, with the upper limit being preferably not more than 5 parts by weight, more preferably not more than 3 parts by weight, and even more preferably not more than 2.5 parts by weight. When the amount of organosulfur compound included is too large, further improvement in the rebound (especially on shots with a W#1) is unlikely to occur, the core may become too soft and the feel at impact may worsen. On the other hand, when the amount included is too small, an improvement in the resilience may be unlikely to occur.

Core production may be carried out in the customary manner by molding a spherical core using heat and pressure under vulcanization conditions of at least 140° C. and up to 180° C. and at least 10 minutes and up to 60 minutes.

Next, the cover which encases the core is described.

The cover which encases the core is not limited to one layer, and may be formed of a plurality of two or more layers. The material hardness of each cover layer, expressed in terms of Shore D hardness, although not particularly limited, is preferably at least 50, and more preferably at least 54, with the upper limit being preferably not more than 60, more preferably not more than 58, and even more preferably not more than 56. When the hardness is too low, the spin rate on full shots may rise or the initial velocity of the ball may decrease, as a result of which a good distance may not be achieved. On the other hand, when the hardness is too high, the feel at impact in the short game may become harder or the durability to cracking on repeated impact may worsen.

The thickness of each cover layer, although not particularly limited, is preferably at least 1.1 mm, more preferably at least 1.3 mm, and even more preferably at least 1.4 mm, with the upper limit being preferably not more than 1.8 mm, more preferably not more than 1.65 mm, and even more preferably not more than 1.5 mm. When the respective cover layers are thicker than the above range, the initial velocity of the ball may decrease or the spin rate may rise, as a result of which a good distance may not be achieved. On the other hand, when the respective cover layers are thinner than the above range, the durability to cracking on repeated impact may worsen, or the spin rate may rise, as a result of which a good distance may not be achieved.

The materials of the respective cover layers may be formed of known synthetic resins, examples of which include thermoplastic resins such as ionomer resins, and various types of thermoplastic elastomers. Illustrative examples of thermoplastic elastomers include polyester-type thermoplastic elastomers, polyamide-type thermoplastic elastomers, polyurethane-type thermoplastic elastomers, olefin-type thermoplastic elastomers and styrene-type thermoplastic elastomers.

In addition to the above resin component, various additives may be optionally included in the resin material used to form the cover. For example, various types of additives such as pigments, dispersants, antioxidants, ultraviolet absorbers, ultraviolet stabilizers, mold release agents, plasticizers and inorganic fillers (e.g., zinc oxide, barium sulfate, titanium dioxide) may be used.

The cover-forming resin material has a melt flow rate, as measured in accordance with UIS K 6760 at a test temperature of 190° C. and a test load of 21 N (2.16 kgf), which, although not particularly limited, is preferably at least 3.0 g/10 min, and more preferably at least 4.0 g/10 min. This ensures that the hot resin mixture has good flow properties, enabling the processability and material properties to be enhanced.

The method of manufacturing a golf ball in which the cover layer or layers are successively formed over the core may be carried out by a commonly used method such as a known injection molding process. For example, the golf ball may be obtained by placing, as the core, a molded and vulcanized product composed primarily of a rubber material within a given injection mold and then injection-molding the cover material over the core. An alternative method is to enclose the core within two cover-forming half-cups that have been molded beforehand into hemispherical shapes, and subsequently mold the cover under heat and pressure.

During manufacture of the inventive golf ball, a known horizontally separating two-part mold may be used when injection-molding the cover material. One half of this horizontally separating two-part mold is exemplified by, as shown in FIG. 1, a golf ball mold 10 having a spherical cavity 10*a* provided on an inner wall thereof with numerous dimple-forming projections for creating dimples on the ball surface. Also, although not shown in FIG. 1, a runner for supplying the cover material is disposed at the position of the mold parting line PL so as to encircle the cavity. A plurality of gates, typically from 4 to 12, which open out radially from the runner toward the cavity is arranged at equal intervals along the circumference. Also shown in FIG. 1 are support pins 30 and gas venting means 31. The plurality of support pins 30 is arranged on the cavity 10*a* inner wall at given intervals along a circle centered on a pole of the spherical cavity. For example, three support pins 30 may be thus arranged at intervals of 120°. The support pins 30 are arranged in such manner as to be capable of extending and retracting within holes of circular cross-section in the horizontally separating mold. The support pins 30 function so as to, in the extended state, hold the core 2 in place in the manner shown in FIG. 1 while the cover material fills the cavity 10*a*, after which the support pins 30 are retracted to positions on the surface of the cavity inner wall.

In this invention, as shown in FIG. 1, it is preferable to set the positions where the support pins are arranged to less than 21° of a center axis X perpendicular to the mold parting line PL (that is, in the diagram, the angle θ between the center axis X and the perpendicular drawn from the cavity center O toward the cavity wall is less than21°). This makes it possible to hold the core in place with the support pins up until just before the resin finishes spreading throughout the mold cavity during cover molding, and moreover prevents core eccentricity from arising, enabling a high durability to cracking under repeated impact to be achieved.

The positions at which the support pins are arranged, expressed as the above angle θ, are preferably less than 21°, more preferably not more than 18°, and even more preferably not more than 15°. The lower limit is preferably at least 10°, more preferably at least 11°, and even more preferably at least 12°. When this angle θ is too large, the support pins come into contact with the molten resin within the cavity during injection molding of the cover material, which may, after molding, worsen the durability of the ball to cracking on repeated impact. On the other hand, when the angle θ is too small, the positions of the support pins are too close to the pole of the cavity, making it impossible to properly seat the core on the typically three or more support pins, as a result of which molding may be difficult to carry out.

The golf ball has a deflection (mm) when compressed under a final load of 1,275 N (130 kgf) from an initial load of 98 N (10 kgf) which, although not particularly limited, is preferably at least 3.3 mm, more preferably at least 3.6 mm, and even more preferably at least 3.8 mm. The upper limit is preferably not more than 5.0 mm, more preferably not more than 4.7 mm, and even more preferably not more than 4.5 mm. When this value is too small, the feel at impact may be too hard; also, the spin rate on full shots may increase, as a result of which the intended distance may not be achieved. Conversely, when this value is too large, the feel at impact may be too soft, resulting in a feel that lacks crispness, or the durability to cracking at repeated impact may worsen.

The golf ball has a surface hardness (surface hardness when the core is encased by a cover), expressed in terms of Shore D hardness, which, although not particularly limited, is preferably at least 56, and more preferably at least 60. The upper limit is preferably not more than 66, more preferably not more than 64, and even more preferably not more than 62. The Shore D hardness value obtained by subtracting the core surface hardness from the ball surface hardness (ball surface hardness—core surface hardness), although not particularly limited, is preferably at least 1, more preferably at least 5, and even more preferably at least 10. The upper limit is preferably not more than 25, more preferably not more than 22, and even more preferably not more than 18. When this value is too large, the durability to cracking under repeated impact may worsen, and the feel of the ball in the short game may become harder. On the other hand, when this value is too small, the spin rate on full shots may rise, as a result of which the intended distance may not be achieved.

The initial velocity of the ball, in order to conform to the R&A rules, is preferably not greater than 77.724 m/s. The lower limit is preferably not less than 76 m/s, more preferably not more less than 76.5 m/s, and even more preferably not less than 77 m/s. When the ball initial velocity is too low, the initial velocity on shots with a W#1 club becomes low, as a result of which the intended distance may not be achieved. The initial velocity of the ball is measured using the measurement apparatus and conditions described subsequently under Initial Velocities of Core and Ball in the "Examples" section of this specification.

Moreover, in this invention, by satisfying conditions (1) to (3) below, the ball can be imparted with an excellent flight performance and a soft feel when used by golfers whose head speed is not very fast, such as senior golfers and women golfers, in addition to which the ball can be endowed with a high durability to cracking.

(1) Cover Diameter/Cover Thickness

Letting the core diameter be D (mm) and the cover thickness be T (mm), the value D/T is at least 24, preferably at least 25, and more preferably at least 26. The upper limit is not more than 30, preferably not more than 29.5, and even more preferably not more than 29. When this value is too large, the durability to cracking on repeated impact may worsen. When this value is too small, the spin rate on full shots may increase and the ball initial velocity may decrease, as a result of which the intended distance on shots with a W#1 club may not be achieved.

(2) Core Deflection/Cover Thickness

Letting the deflection of the core when compressed under a final load of 1,275 N (130 kgf) from an initial load of 98 N (10 kgf) be E (mm) and the cover thickness be T (mm), the value E/T is at least 2.6, preferably at least 2.9, and more preferably at least 3.1. The upper limit is not more than 4.1, preferably not more than 3.9, and even more preferably not more than 3.8. When this value is too large, the durability to cracking under repeated impact may worsen. When this value is too small, the spin rate on full shots may increase and the ball initial velocity may decrease, as a result of which the intended distance on shots with a W#1 club may not be achieved.

(3) Core Deflection/Ball Deflection

Letting the deflections of the core and golf ball when compressed under a final load of 1,275 N (130 kgf) from an initial load of 98 N (10 kgf) be respectively E (mm) and B (mm), the value E/B is at least 1.09, and the upper limit is not more than 1.18, preferably not more than 1.16, and more preferably not more than 1.14. When this value is too large, the durability to cracking on repeated impact may worsen. On the other hand, when this value is too small, the spin rate on full shots may increase and the ball initial velocity may decrease, as a result of which the intended distance on shots with a W#1 club may not be achieved.

Numerous dimples may be formed on the outside surface of the cover. The number of dimples arranged on the outside surface of the cover, although not particularly limited, is preferably at least 280, more preferably at least 300, and even more preferably at least 320, with the upper limit being preferably not more than 360, more preferably not more than 350, and even more preferably not more than 340. When the number of dimples is larger than this range, the ball trajectory becomes lower, as a result of which a good distance may not be achieved. On the other hand, when the number of dimples is smaller that this range, the ball trajectory becomes higher, as a result of which an increased distance may not be achieved.

The dimple shapes that are used may be of one type or a combination of two or more types selected from among circular shapes, various polygonal shapes, dewdrop shapes and oval shapes. When circular dimples are used, the dimple diameter may be set to at least about 2.5 mm and up to about 6.5 mm, and the dimple depth may be set to from 0.08 mm to 0.30 mm.

The dimple surface coverage SR, defined as the ratio of the sum of the individual dimple surface areas, each representing the hypothetical spherical surface circumscribed by the edge of a dimple, with respect to the hypothetical spherical surface area of the ball were it to have no dimples thereon may be set to from 60 to 90%. The dimple volume occupancy Vr, defined as the ratio of the sum of the spatial volumes of the individual dimples, each formed below the flat plane circumscribed by the edge of a dimple, with respect to the volume of a hypothetical sphere were the ball to have no dimples thereon, may be set to from 0.6% to 1.0%. The value $V_0$, defined as the spatial volume of the individual dimples below the flat plane circumscribed by the dimple edge, divided by the volume of the cylinder whose base is the flat plane and whose height is the maximum depth of the dimple from the base, may be set to from 0.35 to 0.80. By setting SR, VR and $V_0$ within these ranges, air resistance is reduced and the ball readily assumes a trajectory that allows a good distance to be achieved, enabling the flight performance to be improved.

The golf ball of the invention can be made to conform to the Rules of Golf for play. Specifically, this ball may be formed to a diameter which is such that the ball does not pass through a ring having an inner diameter of 42.672 mm and is not more than 42.80 mm, and to a weight which is generally from 45.0 to 45.93 g.

EXAMPLES

The following Examples and Comparative Examples are provided to illustrate the invention, and are not intended to limit the scope thereof.

Examples 1 to 6, Comparative Examples 1 to 6

Formation of Core

Single-layer cores for all of the working examples of the invention and comparative examples were produced by preparing the core-forming rubber compositions formulated as shown in Table 1 below, then molding and vulcanizing the compositions at 155° C. for 15 minutes.

TABLE 1

| Core formulation | Example | | | | | | Comparative Example | | | | | |
|---|---|---|---|---|---|---|---|---|---|---|---|---|
| (pbw) | 1 | 2 | 3 | 4 | 5 | 6 | 1 | 2 | 3 | 4 | 5 | 6 |
| Polybutadiene I | 100 | | | 100 | 100 | | | | | | 100 | 100 |
| Polybutadiene II | | 100 | 100 | | | 100 | 100 | 100 | 100 | 100 | | |
| Zinc acrylate | 22.5 | 27.5 | 25.5 | 22.5 | 24.5 | 23.5 | 27.5 | 27.5 | 23.5 | 25.5 | 25.0 | 22.5 |
| Organic peroxide (1) | 0.6 | 0.6 | 0.6 | 0.6 | 0.6 | 0.6 | 0.6 | 0.6 | 0.6 | 0.6 | 0.6 | 0.6 |
| Organic peroxide (2) | 0.6 | 0.6 | 0.6 | 0.6 | 0.6 | 0.6 | 0.6 | 0.6 | 0.6 | 0.6 | 0.6 | 0.6 |
| Titanium oxide (titanium white) | 2 | 2 | 2 | 2 | 2 | 2 | 2 | 2 | 2 | 2 | 2 | 2 |
| Antioxidant | 0.1 | 0.1 | 0.1 | 0.1 | 0.1 | 0.1 | 0.1 | 0.1 | 0.1 | 0.1 | 0.1 | 0.1 |
| Zinc oxide | 23.0 | 20.8 | 21.6 | 23.0 | 21.9 | 21.6 | 23.3 | 24.5 | 22.1 | 21.6 | 21.8 | 21.8 |
| Zinc salt of pentachlorothiophenol | 1 | 1 | 1 | 1 | 1 | 1 | 1 | 1 | 0.1 | 1 | 0.5 | 1 |

Trade names of the chief materials mentioned in the table are given below. Numbers in the table represent parts by weight.

Polybutadiene I: Available under the trade name "BR 01" from JSR Corporation

Polybutadiene II: Available under the trade name "BR 51" from JSR Corporation

Organic Peroxide (1): Dicumyl peroxide, available under the trade name "Percumyl D" from NOF Corporation Organic Peroxide (2): A mixture of 1,1-di(t-butylperoxy)-cyclohexane and silica, available under the trade name "Perhexa C-40" from NOF Corporation Titanium oxide: Tipaque A-100, available from Ishihara Sangyo Kaisha, Ltd.

Antioxidant: 2,2'-Methylenebis(4-methyl-6-t-butylphenol), available under the trade name "Nocrac NS-6" from Ouchi Shinko Chemical Industry Co., Ltd.

Zinc oxide: Available under the trade name "Zinc Oxide Grade 3" from Sakai Chemical Co., Ltd.

Zinc salt of pentachlorothiophenol: Available from ZHEJIANG CHO & FU CHEMICAL

Formation of Cover Layer

Figure 2:
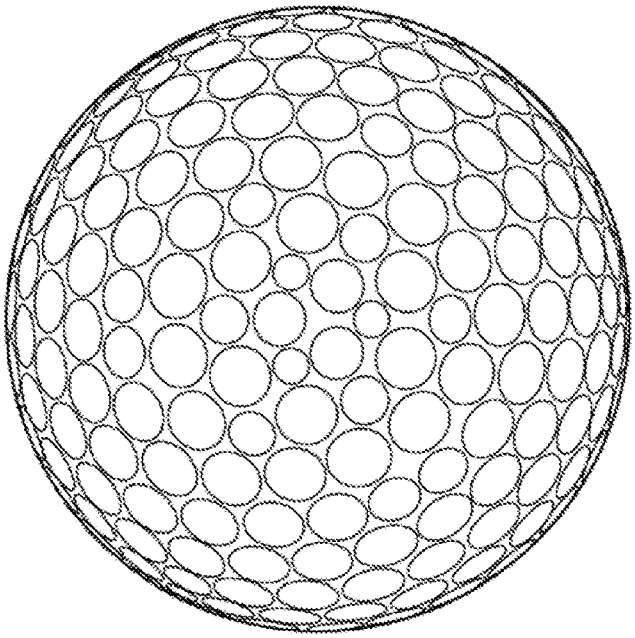
FIG. 2 is a top view of a golf ball showing the dimple configuration used in the working examples provided herein.

Next, in the respective examples, the cover-forming resin material shown in Table 2 was injection-molded using a given golf ball mold (see FIG. 1) so as to cover the periphery of the single-layer core with a single cover layer. Two-piece solid golf balls were produced in which dimples were formed on the outside surface of the ball cover in a common dimple pattern for all the balls (see Table 3 and FIG. 2).

TABLE 2

| Resin material ingredients (pbw) | No. 1 | No. 2 | No. 3 | No. 4 |
|---|---|---|---|---|
| Himilan 1557 | 37.5 | 32.5 | 50 | |
| Himilan 1601 | 37.5 | 32.5 | 50 | |
| Surlyn 8120 | | | | 37.5 |
| Himilan 1855 | | | | 37.5 |
| Nucrel AN4319 | 25 | 35 | | 25 |
| Titanium oxide | 3 | 3 | 3 | 3 |
| Magnesium stearate | 1 | 1 | 1 | 1 |

Trade names of the chief materials mentioned in the table are given below.

Himilan: Ionomers available from DuPont-Mitsui Polychemicals Co., Ltd.

Surlyn: An ionomer available from E.I. DuPont de Nemours & Co. (U.S.A.)

Nucrel: An ethylene-methacrylic acid copolymer available from DuPont-Mitsui Polychemicals Co., Ltd.

Titanium oxide: Tipaque R-550, available from Ishihara Sangyo Kaisha, Ltd.

Magnesium stearate: Available as "Magnesium Stearate G" from NOF Corporation

TABLE 3

| No. | Number of dimples | Diameter (mm) | Depth (mm) | $V_0$ | SR (%) | VR (%) |
|---|---|---|---|---|---|---|
| 1 | 12 | 4.6 | 0.15 | 0.47 | 0.81 | 0.783 |
| 2 | 234 | 4.4 | 0.15 | 0.47 | | |
| 3 | 60 | 3.8 | 0.14 | 0.47 | | |
| 4 | 6 | 3.5 | 0.13 | 0.46 | | |
| 5 | 6 | 3.4 | 0.13 | 0.46 | | |
| 6 | 12 | 2.6 | 0.10 | 0.46 | | |
| Total | 330 | | | | | |

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

SR: Sum of individual dimple surface areas, each defined by the flat plane circumscribed by the edge of a dimple, as a percentage of the surface area of a hypothetical sphere were the ball to have no dimples on the surface thereof.

VR: Sum of spatial volumes of individual dimples formed below flat plane circumscribed by the edge of a dimple, as a percentage of the volume of a hypothetical sphere were the ball to have no dimples on the surface thereof.

The core and ball surface hardness, initial velocities and other physical properties, as well as the flight performance, feel at impact and durability to impact of the ball were evaluated based on the following criteria for each golf ball produced in Examples 1 to 4 and Comparative Examples 1 to 6. The results are shown in Table 4. All measurements were carried out in a 23° C. environment.

Core Diameter

The diameters at five random places on the surface of a core were measured at a temperature of 23.9±1° C. and, using the average of these measurements as the measured value for a single core, the average diameter for five measured cores was determined.

Ball Diameter

The diameters at five random dimple-free areas on the surface of a ball were measured at a temperature of 23.9±1° C. and, using the average of these measurements as the measured value for a single ball, the average diameter for five measured balls was determined.

Deflections of Core and Ball

A core or ball was placed on a hard plate and the amount of deflection when compressed under a final load of 1,275 N (130 kgf) from an initial load of 98 N (10 kgf) was measured for each. The amount of deflection here refers in each case to the measured value obtained after holding the test specimen isothermally at 23.9° C.

Center and Surface Hardnesses of Core (Shore D Hardness and JIS-C Hardness)

The hardness in places other than the surface of a core were obtained by cutting the core in half through the center and measuring the hardnesses at various positions on the resulting cross-section. The hardness at the surface of the core was measured by pressing a durometer indenter perpendicularly against the surface of the spherical core.

JIS-C hardnesses were measured with the spring-type durometer (JIS-C model) specified in JIS K 6301-1975. Shore D hardnesses were measured with a type D durometer in accordance with ASTM D2240-95.

Material Hardness of Cover (Shore D Hardness)

The cover-forming resin materials were formed into sheets having a thickness of 2 mm and left to stand for at least two weeks, following which the Shore D hardnesses were measured in accordance with ASTM D2240-95.

Melt Flow Rate (MFR)

The melt flow rates of the cover-forming resin materials are values measured in accordance with JIS K 6760 (test temperature, 190° C.; test load, 21 N (2.16 kgf)).

Positions of Support Pins in Mold

Using the golf ball mold shown in FIG. 1, three support pins 30 were used in each part of the split mold. With regard to the positions at which the support pins were placed, the pins were set at θ=15° with respect to a center axis X perpendicular to the mold parting line PL in Examples 1 to 3 and Comparative Examples 1 to 6, and at θ=21° in Example 4.

Surface Hardness of Ball (Shore D Hardness)

Measurements were taken by pressing the durometer indenter perpendicularly against the surface of the ball (consisting of a core encased by a cover). The surface hardness of the ball is the measured value obtained at dimple-free places (lands) on the ball surface. The Shore D hardnesses were measured with a type D durometer in accordance with ASTM D2240-95.

Initial Velocities of Core and Ball

The initial velocities were measured using an initial velocity measuring apparatus of the same type as the USGA drum rotation-type initial velocity instrument approved by the R&A. The cores and balls (referred to below as "spherical test specimens") were held isothermally in a 23.9±1° C. environment for at least 3 hours, and then tested in a chamber at a room temperature of 23.9±2° C. Each test specimen was hit using a 250-pound (113.4 kg) head (striking mass) at an impact velocity of 143.8 ft/s (43.83 m/s). One dozen spherical test specimens were each hit four times. The time taken for the test specimen to traverse a distance of 6.28 ft (1.91 m) was measured and used to compute the initial velocity (m/s). This cycle was carried out over a period of about 15 minutes.

Flight Performance on Shots with a Driver

A W#1 club was mounted on a golf swing robot, and the distance traveled by the ball when struck at a head speed (HS) of 35 m/s was measured. The W#1 club was a Tour Stage PHYZ driver (2011 model; loft angle,)11.5°), manufactured by Bridgestone Sports Co., Ltd. The flight performance was rated according to the criteria shown below. The spin rate is the value measured immediately after the ball is struck, as obtained with an apparatus for measuring the initial conditions.

Good: Total distance was 166.0 m or more

NG: Total distance was less than 166.0 m

Feel

The balls were hit with the same type of W#1 club as above by amateur golfers having head speeds of 30 to 40 m/s, and sensory evaluations were carried out under the following criteria.

Good: Ball had a soft feel at impact

NG: Ball felt hard

Durability to Cracking

The ball was repeatedly hit at a head speed of 35 m/s with the same type of driver (W#1) as above mounted on a golf swing robot. For the ball in each example, a loss of durability was determined to have occurred when the initial velocity of the ball fell to or below 97% of the average initial velocity for the first ten shots. The average value for N=3 golf balls was used as the basis for evaluation in each example. The durability indexes for the balls in the respective examples were calculated relative to an arbitrary index of 100 for the number of shots taken with the ball in Example 3, and the durability to cracking was rated according to the following criteria.

Good: Durability index was 95 or more

Fair: Durability index was at least 90 but less than 95

NG: Durability index was less than 90

TABLE 4

| | | | Example | | | | | |
|---|---|---|---|---|---|---|---|---|
| | | | 1 | 2 | 3 | 4 | 5 | 6 |
| Ball construction | | | 2 piece | 2 piece | 2 piece | 2 piece | 2 piece | 2 piece |
| Core | Diameter (mm) | | 39.7 | 39.9 | 39.9 | 39.7 | 39.4 | 39.9 |
| | Weight (g) | | 38.0 | 38.6 | 38.6 | 38.0 | 37.1 | 38.4 |
| | Deflection (mm) | | 4.75 | 4.45 | 4.75 | 4.75 | 4.45 | 5.00 |
| | Initial velocity (m/s) | | 77.8 | 78.1 | 77.8 | 77.8 | 77.8 | 77.6 |
| | Core hardness profile (JIS-C) | Surface hardness (Cs) | 72 | 74 | 72 | 72 | 74 | 71 |
| | | Hardness at position 15 mm from center | 67 | 70 | 67 | 67 | 70 | 66 |
| | | Hardness at position 10 mm from center | 64 | 66 | 64 | 64 | 66 | 63 |
| | | Hardness at position 5 mm from center | 59 | 62 | 59 | 59 | 62 | 58 |
| | | Center hardness (Cc) | 57 | 58 | 57 | 57 | 58 | 56 |
| | | Surface hardness − Center hardness (Cs − Cc) | 15 | 16 | 15 | 15 | 16 | 15 |
| | Surface hardness (Shore D): A | | 47 | 48 | 47 | 47 | 48 | 46 |
| Cover | Material | | No. 1 | No. 2 | No. 2 | No. 1 | No. 1 | No. 2 |
| | Hardness (mm) | | 1.5 | 1.4 | 1.4 | 1.5 | 1.65 | 1.4 |
| | Specific gravity | | 0.98 | 0.97 | 0.97 | 0.98 | 0.98 | 0.97 |
| | Material hardness (Shore D) | | 56 | 54 | 54 | 56 | 56 | 54 |
| | Melt flow rate (g/10 min) | | 6.5 | 7.8 | 7.8 | 6.5 | 6.5 | 7.8 |
| Mold cavity | Support pin positions (angle relative to center axis perpendicular to parting line) | | 15° | 15° | 15° | 21° | 15° | 15° |
| Ball | Diameter (mm) | | 42.7 | 42.7 | 42.7 | 42.7 | 42.7 | 42.7 |
| | Weight (g) | | 45.5 | 45.5 | 45.5 | 45.5 | 45.5 | 45.5 |
| | Deflection (mm) | | 4.2 | 4.1 | 4.3 | 4.2 | 3.9 | 4.5 |
| | Initial velocity (m/s) | | 77.3 | 77.2 | 77.2 | 77.3 | 77.3 | 77.2 |
| | Surface hardness (Bs) (Shore D): B | | 62 | 60 | 60 | 62 | 62 | 60 |
| | Core deflection/Cover thickness | | 3.2 | 3.2 | 3.4 | 3.2 | 2.7 | 3.6 |
| | Core diameter/Cover thickness | | 26.5 | 28.5 | 28.5 | 26.5 | 23.9 | 28.5 |
| | Core deflection/Ball deflection | | 1.13 | 1.09 | 1.10 | 1.13 | 1.14 | 1.11 |
| | Surface hardness difference between ball and core (B − A) | | 15 | 12 | 13 | 15 | 14 | 14 |
| | Core initial velocity − Ball initial velocity (m/s) | | 0.5 | 0.9 | 0.6 | 0.5 | 0.5 | 0.4 |
| Ball properties | W#1 | Spin rate (rpm) | 2672 | 2777 | 2717 | 2675 | 2789 | 2656 |
| | HS, | Total distance (m) | 167.2 | 166.4 | 166.7 | 167.1 | 166.1 | 167.3 |
| | 35 m/s | Rating | good | good | good | good | good | good |
| | Feel at impact | | good | good | good | good | good | good |
| | Durability on repeated impact | | good | good | good | fair | good | fair |

| | | | Comparative Example | | | | | |
|---|---|---|---|---|---|---|---|---|
| | | | 1 | 2 | 3 | 4 | 5 | 6 |
| Ball construction | | | 2 piece | 2 piece | 2 piece | 2 piece | 2 piece | 2 piece |
| Core | Diameter (mm) | | 38.9 | 38.5 | 39.9 | 39.7 | 39.7 | 40.3 |
| | Weight (g) | | 36.2 | 35.3 | 38.6 | 38.0 | 38.0 | 39.5 |

TABLE 4-continued

| | | | | | | | | |
|---|---|---|---|---|---|---|---|---|
| | Deflection (mm) | | 4.45 | 4.45 | 4.75 | 4.75 | 3.8 | 4.75 |
| | Initial velocity (m/s) | | 78.1 | 78.1 | 77.8 | 77.8 | 78.3 | 77.8 |
| | Core hardness profile (JIS-C) | Surface hardness (Cs) | 74 | 74 | 72 | 72 | 80 | 72 |
| | | Hardness at position 15 mm from center | 70 | 70 | 67 | 67 | 75 | 67 |
| | | Hardness at position 10 mm from center | 66 | 66 | 64 | 64 | 70 | 64 |
| | | Hardness at position 5 mm from center | 62 | 62 | 59 | 59 | 67 | 59 |
| | | Center hardness (Cc) | 58 | 58 | 57 | 57 | 62 | 57 |
| | | Surface hardness – Center hardness (Cs – Cc) | 16 | 16 | 15 | 15 | 18 | 15 |
| | Surface hardness (Shore D): A | | 48 | 48 | 47 | 47 | 53 | 47 |
| Cover | Material | | No. 2 | No. 2 | No. 3 | No. 4 | No. 2 | No. 1 |
| | Hardness (mm) | | 1.9 | 2.1 | 1.4 | 1.5 | 1.5 | 1.2 |
| | Specific gravity | | 0.97 | 0.97 | 0.98 | 0.97 | 0.97 | 0.98 |
| | Material hardness (Shore D) | | 54 | 54 | 60 | 50 | 54 | 56 |
| | Melt flow rate (g/10 min) | | 7.8 | 7.8 | 2.0 | 4.5 | 7.8 | 6.5 |
| Mold cavity | Support pin positions (angle relative to center axis perpendicular to parting line) | | 15° | 15° | 15° | 15° | 15° | 15° |
| Ball | Diameter (mm) | | 42.7 | 42.7 | 42.7 | 42.7 | 42.7 | 42.7 |
| | Weight (g) | | 45.6 | 45.6 | 45.7 | 45.5 | 45.5 | 45.5 |
| | Deflection (mm) | | 4.0 | 3.9 | 4.0 | 4.4 | 3.5 | 4.5 |
| | Initial velocity (m/s) | | 76.7 | 76.4 | 77.3 | 76.8 | 77.3 | 77.4 |
| | Surface hardness (Bs) (Shore D): B | | 60 | 60 | 66 | 56 | 60 | 62 |
| | Core deflection/Cover thickness | | 2.3 | 2.1 | 3.4 | 3.2 | 2.5 | 4.0 |
| | Core diameter/Cover thickness | | 20.5 | 18.3 | 28.5 | 26.5 | 26.5 | 33.6 |
| | Core deflection/Ball deflection | | 1.11 | 1.14 | 1.19 | 1.08 | 1.09 | 1.06 |
| | Surface hardness difference between ball and core (B – A) | | 12 | 12 | 19 | 9 | 7 | 15 |
| | Core initial velocity – Ball initial velocity (m/s) | | 1.4 | 1.7 | 0.5 | 1.0 | 1.0 | 0.4 |
| Ball properties | W#1 | Spin rate (rpm) | 2833 | 2888 | 2652 | 2772 | 2822 | 2695 |
| | HS, | Total distance (m) | 164.5 | 163.8 | 167.5 | 164.5 | 165.7 | 167.4 |
| | 35 m/s | Rating | NG | NG | good | NG | NG | good |
| | Feel at impact | | good | good | good | good | NG | good |
| | Durability on repeated impact | | good | good | NG | good | good | NG |

From the results in Table 4, in Comparative Example 1, the core diameter/cover thickness value was smaller than 24 and the core deflection/cover thickness value was smaller than 3.0. As a result, the spin rate on shots with a W#1 club rose and the intended distance was not achieved.

In Comparative Example 2, the core diameter/cover thickness value was smaller than 24 and the core deflection/cover thickness value was smaller than 3.0. As a result, the spin rate on shots with a W#1 club rose and the intended distance was not achieved.

In Comparative Example 3, the core deflection/ball deflection value was larger than 1.18 and the cover was hard. As a result, the durability to cracking on repeated impact was poor.

In Comparative Example 4, the core deflection/ball deflection value was smaller than 1.09 and the cover was soft. As a result, the initial velocity decreased and the spin rate rose, and so the intended distance on shots with a W#1 club was not achieved.

In Comparative Example 5, the core deflection/cover thickness value was smaller than 3.0 and the core deflection was small. As a result, the feel at impact was poor and the spin rate on shots with a W#1 club rose, and so the intended distance was not achieved.

In Comparative Example 6, the cover thickness was small, the cover deflection/cover thickness value and the core diameter/cover thickness value were both larger than the specified ranges, and the core deflection/ball deflection value was smaller than the specified range. As a result, the durability on repeated impact was poor.

Japanese Patent Application No. 2015-040086 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising a core and a cover of one or more layer, wherein, letting the core have a diameter D (mm), the cover have a thickness T (mm), and the core and the golf ball have respective deflections E (mm) and B (mm) when compressed under a final load of 1,275 N (130 kgf) from an initial load state of 98 N (10 kgf), conditions (1) to (3) below are satisfied:

(1) 30≥D/T 24, (2) 4.1≥E/T≥2.6, and (3) 1.18≥E/B≥1.09, and wherein the initial velocity of the ball is from 76.5 to 77.724 m/s, and wherein the core has a hardness profile with, expressed in terms of JIS-C hardness, a core center hardness of 58±5, a hardness at a position 5 mm from the core center of 62±5, a hardness at a position 10 mm from the core center of 65±5, a hardness at a position 15 mm from the core center of 70±5, and a hardness on a surface of the core of 75±5.

2. The golf ball of claim 1, wherein, in formula (3), B is at least 3.8 mm.

3. The golf ball of claim 1, wherein, in formula (3), E is from 4.4 to 6.0 mm.

4. The golf ball of claim 1, wherein, in the core hardness profile, the JIS-C hardness value obtained by subtracting the core center hardness from the core surface hardness is at least 10 and up to 25.

5. The golf ball of claim 1, wherein, in formula (2), E/T is at least 3.2 and up to 3.5.

6. The golf ball of claim 1, wherein the material hardness of each cover layer, expressed in terms of Shore D hardness, is from 50 to 60.

7. The golf ball of claim 1, wherein the Shore D hardness value obtained by subtracting the core surface hardness from the ball surface hardness (ball surface hardness—core surface hardness), is from 5 to 25.

8. The golf ball of claim 1, wherein the core is formed primarily of a rubber material including a base rubber and zinc acrylate as a co-crosslinking agent.

9. The golf ball of claim 8, wherein the amount of zinc acrylate is from 10 to 27.5 parts by weight, per 100 parts by weight of the base rubber.

* * * * *